US006054239A

United States Patent [19]

Ohira et al.

[11] Patent Number: 6,054,239

[45] Date of Patent: Apr. 25, 2000

[54] TONER

[75] Inventors: Hideo Ohira, Tajimi; Akira Endo, Nagoya, both of Japan

[73] Assignee: Brother Kogyo Kabushiki Kaisha, Nagoya, Japan

[21] Appl. No.: 09/135,534

[22] Filed: Aug. 18, 1998

[30] Foreign Application Priority Data

Aug. 21, 1997 [JP] Japan ..... 9-225018
Aug. 22, 1997 [JP] Japan ..... 9-226022

[51] Int. Cl.[7] ..... G03G 9/08

[52] U.S. Cl. ..... 430/106; 430/111

[58] Field of Search ..... 430/106, 109, 430/111

[56] References Cited

U.S. PATENT DOCUMENTS

| | | | |
|---|---|---|---|
| 4,758,491 | 7/1988 | Alexandrovich et al. . | |
| 5,066,558 | 11/1991 | Hikake et al. | 430/109 |
| 5,102,761 | 4/1992 | Ohsaki et al. | 430/106 |
| 5,445,910 | 8/1995 | Ishikawa et al. . | |

FOREIGN PATENT DOCUMENTS

| | | |
|---|---|---|
| 0 207 628 | 1/1987 | European Pat. Off. . |
| 0 335 676 | 10/1989 | European Pat. Off. . |
| 0 703 503 A1 | 3/1996 | European Pat. Off. . |
| 0 715 218 A1 | 6/1996 | European Pat. Off. . |
| 1-293354 | 11/1989 | Japan . |
| 4-287052 | 10/1992 | Japan . |
| 6-337543 | 12/1994 | Japan . |
| 7-114213 | 5/1995 | Japan . |
| 8-310037 | 11/1996 | Japan . |
| 9-1851 | 1/1997 | Japan . |

*Primary Examiner*—John Goodrow
*Attorney, Agent, or Firm*—Oliff & Berridge PLC

[57] ABSTRACT

A toner comprises toner particles which have been colored with a dye and have a volume mean diameter of several $\mu$m, and to which silicone fine particles are externally added. A dry-development toner comprises resin particles having been colored with a dye, wherein the surfaces of resin particles are coated with a fine organic powder having a mean particle diameter of 0.8 $\mu$m or less by means of mechanical impact force.

7 Claims, 4 Drawing Sheets

| | Example 1 (Toner 1) | Comparative Example 1 (Toner 2) |
|---|---|---|
| Tospearl externally added (weight parts) | 3 | 0 |
| Solid density | 1.41 | 1.43 |
| Fogging density | 0.10 | 0.42 |

FIG.1

| | Example 2 (Toner 3) | Example 3 (Toner 4) | Example 4 (Toner 5) | Comparative Example 2 (Toner 6) |
|---|---|---|---|---|
| Tospearl externally added (weight parts) | 0.5 | 1.0 | 3.0 | 0.0 |
| Projection rate (%) (+70V) | 59.21 | 75.59 | 90.67 | 38.90 |
| Fogging density (−30V) | 0.12 | 0.17 | 0.25 | 0.09 |
| Solid density (+70V) | 1.14 | 1.35 | 1.47 | 0.92 |

FIG.2

Evaluation results of fixing strength

| | Transmission density of unrubbed black solid | Transmission density of rubbed black solid | Difference in tranmission density | Evaluation of fixing stength |
|---|---|---|---|---|
| Toner A (N-30 coated) | 3.45 | 3.46 | −0.01 | Good |
| Toner B (MP-1450 coated) | 2.69 | 2.68 | +0.01 | Good |
| Toner C (N-32 coated) | 3.26 | 3.28 | −0.02 | Good |
| Toner D (MP-1000 coated) | 2.49 | 2.49 | ±0.00 | Good |
| Toner E (Tospearl 105 coated) | 2.98 | 2.98 | ±0.00 | Good |
| Toner F (Luvulon L-2 coated) | 3.11 | 3.11 | ±0.00 | Good |
| Toner G (N-70 coated) | 2.58 | 2.61 | −0.03 | Good |

FIG.5

TONER

BACKGROUND OF THE INVENTION

1. Field of the Invention

The first present invention relates to a toner which is suitable for use in copiers, printers, plotters, faxes and the like. More particularly it relates to a toner in which silicone fine particles are used as an external additive, allowing image fogging to be controlled and higher image density to be maintained so as to improve contrast.

The second present invention relates to a dry-development toner that contains, as its principal component, resin particles having been colored with a dye, and that is suitable for use in copiers, printers, plotters, faxes and the like. More particularly it relates to a dry-development toner in which fogging, blank spots, and other image defects caused by the presence of charge-controlling agents can be prevented, and in which the strength with which images are fixed to printing paper can be improved, by coating the surfaces of resin particles with a fine organic powder by means of mechanical impact force without the use of charge-controlling agents.

2. Related Art of the Invention

With respect to the related art of the first present invention, various types of toners have been proposed in the past for toners used in copiers and the like. In such toners, to the toner particles (virgin toner particles) such as polymer resin particles or powdered resin particles, are externally added some type of an organic fine powder or inorganic fine powder to improve the fluidity or the like. Of these fine powders, the hydrophobic silica fine particles are most generally used.

The external addition of the hydrophobic silica fine particles to virgin toner particles is made by mixing the hydrophobic silica fine particles with the virgin toner particles, and further stirring the mixture for a predetermined period of time in a mixer. This allows the hydrophobic silica fine particles to be completely and uniformly added to the whole of the virgin toner particles. The toner in which the hydrophobic silica fine particles are externally is then sifted as needed to remove coarse powder such as foreign matters, and it is then ultimately made into a final toner product.

The toner which has been prepared in the manner described above has better fluidity due to the presence of the hydrophobic silica fine particles, and may be used in a variety of image-forming devices.

Image-forming devices such as copiers and printers, however, involve the use of various image-forming processes, and the properties of the toner needed for each type of image-forming process generally differ somewhat. In such cases, the toner particles themselves are sometimes improved or modified in order to ensure that the toner properties are suited to the image-forming process. However, such improvement or modification of the toner particles themselves often produces new inconveniences. Accordingly, an external additive to be mixed with the toner particles is commonly changed to another one.

In view of the foregoing, it is difficult to make toner suitable for the various image-forming processes used in image-forming devices simply by externally adding silica fine particles as the external additive to the toner particles as in the aforementioned conventional toner. Some problems that still persist are the inability to obtain adequate contrast because of the low solid density of the images, image fogging, and a low toner projection rate onto the printing paper.

With respect to the related art of the second present invention, various toners have been proposed in the past as dry-development toners. In image-forming processes using such toners, it is natural that these toners be required to have positive or negative electrification properties. In such cases, charge-controlling agents are commonly added to toners in order to endow it with either type of electrification properties and to control the static charge thereof. Nigrosine-based nucleophilic dyes and the like are used in such cases as charge-controlling agents to impart positive electrification properties to toners, and electrophilic organic complexes composed of oil-soluble metallized dyes and the like are used as charge-controlling agents to impart negative electrification properties to toners.

Although toner electrification can be controlled when such charge-controlling agents are added to toners, these charge-controlling agents are also known to greatly affect toner characteristics other than electrification control.

The addition of charge-controlling agents brings about, for examples, problems in which the photosensitive drums in image-forming devices are contaminated with toners during image formation, raising the residual potential of the photosensitive media on the photosensitive drum and causing image fogging, and in which, conversely, the residual potential of the photosensitive media is lowered, causing blank spots in the images. Another problem is that charge-controlling agents used in a two-component developing toner contaminate the carrier and reduce the static charge of the toner, making it impossible to form images in an appropriate manner.

SUMMARY OF THE INVENTION

As a result of extensive and painstaking research on methods in which the properties of a toner for a given image-forming process are simply modified by adjusting an external additive, in which image fogging is controlled and better image density is maintained to improve contrast, and in which the projection rate of a toner onto printing paper is improved, the first inventor succeeded in discovering that the aforementioned problems relating to various image-forming processes may be resolved by adding silicone fine particles in addition to hydrophobic silica fine particles as the external additive to the toner particles.

An object of the first present invention is thus to provide a toner in which silicone fine particles are externally added to the toner particles, thereby allowing image fogging to be controlled in various image-forming processes and better image density to be maintained so as to improve contrast, as well as allowing the projection rate of the toner onto printing paper to be improved.

To achieve the aforementioned objects, the first present invention provide a toner comprising toner particles which have been colored with a dye and have a volume mean diameter of several $\mu$m, and to which silicone fine particles are externally added.

According to the toner of the first present invention, image fogging can be controlled for various image-forming processes and better image density can be maintained to improve contrast, and the projection rate of the toner onto printing paper can also be improved. This is because the silicone fine particles are used as the externally additive in the toner.

In the toner of the first present invention, it is preferably that hydrophobic silica fine particles are further externally adding to the toner particles.

In the toner of the first present invention, the aforementioned silicone fine particles preferably have a volume mean diameter of no more than 1 μm, and are preferably externally added to the toner particles in an amount of between 0.1 and 3 weight parts per 100 weight parts toner particles. The aforementioned toner particles also preferably comprise resin particles polymerized by dispersion polymerization, and they preferably have a volume mean diameter of no more than about 15 μm.

The toner of the first present invention is suitable for use in image-forming devices featuring various image-forming processes, and it is particularly suitable for use in image-forming devices that are equipped with an electrode array wherein control electrodes are disposed around a plurality of apertures, and with a toner supply means for supplying toner to each of the apertures of the electrode array, and that form images through the selective control of the control electrodes to allow the toner to pass through the apertures and to be projected onto printing paper.

These and other objects, features and advantages of the first present invention are described in or will become apparent from the following detailed description of the invention.

An object of the second present invention, which is aimed at overcoming the above-described problems of the related art of the second present invention, is to provide a dry-development toner in which fogging, blank spots, and other image defects caused by the presence of charge-controlling agents can be prevented, and in which the strength with which images are fixed to printing paper can be improved, by coating the surfaces of resin particles with a fine organic powder by means of mechanical impact force without the use of charge-controlling agents, and adequately adjusting the static charge on the toner with the aid of this fine organic powder.

Aimed at attaining the stated object, the second present invention provides a dry-development toner comprising resin particles having been colored with a dye, wherein the surfaces of resin particles are coated with a fine organic powder having a mean particle diameter of 0.8 μm or less by means of mechanical impact force.

According to the dry-development toner of the second present invention, fogging, blank spots, and other image defects caused by the presence of charge-controlling agents can be prevented, and the strength with which images are fixed to printing paper can be improved. This is because that the surfaces of the dyed resin particles are coated with a fine organic powder having a mean particle diameter of 0.8 μm or less by means of mechanical impact force without the addition of charge-controlling agents, and the static charge on the toner is adequately adjusted with the aid of this fine organic powder.

In the second present invention, the fine organic powder is preferably a fine powder that has been formed from an acrylic resin, fluororesin, or silicon-based resin.

In the second present invention, after coating the surfaces of the resin particles with the fine organic powder, a fine hydrophobic inorganic powder are preferably externally added to the coated resin particles. In addition, the static charge on the toner is preferably adjusted to between about −2 and about −100 μC per gram of toner.

This and other objects, features and advantages of the second present invention are described in or will become apparent from the following detailed description of the invention.

BRIEF DESCRIPTION OF THE DRAWINGS

FIG. 1 is a table comparing the amounts of silicone fine particles externally added to the toner, the solid density, and the fogging density of toners 1 and 2.

FIG. 2 is a table comparing the amounts of silicone fine particles externally added to the toner, the solid density, and the fogging density of toners 3 through 6.

FIG. 5 is a chart depicting the results of evaluating the fixing strength of toners A through G.

THE DETAILED DESCRIPTION OF THE INVENTION

Figure 3:
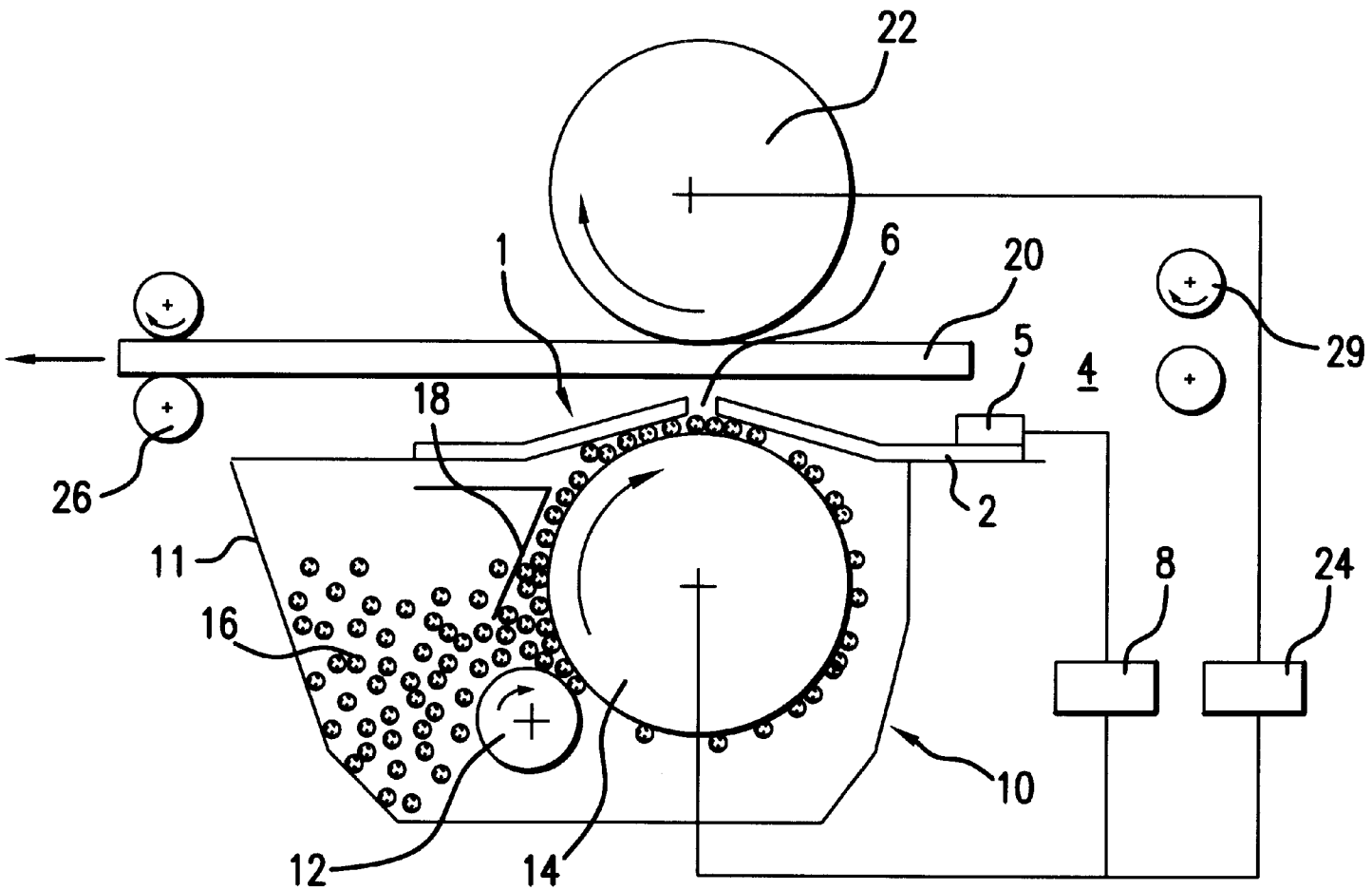
FIG. 3 is a schematic of the general structure of an image-forming device.

The toner of the first present invention is described below with reference to specific embodiments of the invention.

The toner in the embodiments is essentially obtained by externally adding hydrophobic silica with a particle diameter of several tens nm and silicone fine particles with a mean diameter of no more than 0.1 μm to toner particles with a mean particle diameter of several tens μm which have been colored by dye.

Examples of toner particles which can be used include various types of particles such as polymer particles produced by a method such as dispersion polymerization, suspension polymerization, emulsion polymerization, emulsion polymerization aggregation, and seed polymerization; pulverized particles produced by pulverization; and granulated particles produced by granulation. Of these, polymer particles polymerized by dispersion polymerization are particularly preferred. Dispersion polymerization is a method in which solvent is introduced into a polymerization reaction container, materials such as monomers, dispersing agents, and initiators are also introduced and dissolved therein, the contents of the container are placed under an inert gas, the reaction system in the container is heated as the solution is stirred, the particle dispersion is separated into solids and liquids following several hours to some tens of hours of polymerization, and the solid particles are recovered to obtain polymer particles.

A specific method for producing toner particles by dispersion polymerization is described below. To manufacture toner particles by dispersion polymerization, a reactor equipped with a stirrer, condenser, thermometer, gas feed line, and the like is filled with solvent, and the dispersing agent is dissolved therein. Monomer is then mixed therein, and an initiator is also dissolved. This is referred to as the charging.

Examples of solvents include alcohols such as methanol, ethanol, isopropyl alcohol, n-butanol, s-butanol, t-butanol, n-amyl alcohol, s-amyl alcohol, t-amyl alcohol, isoamyl alcohol, isobutyl alcohol, isopropyl alcohol, 2-ethylbutanol, 2-ethylhexanol, 2-octanol, n-octanol, n-decanol, cyclohexanol, n-hexanol, 2-heptanol, 3-heptanol, 3-pentanol, methylcyclohexanol, 2-methyl-2-butanol, 3-methyl-2-butanol, 3-methyl-1-butyn-3-ol, 4-methyl-2-pentanol, and 3-methyl-1-pentyn-3-ol, which can be used either individually or in combinations of two or more. Examples of organic solvents used with such alcohols include hydrocarbons such as hexane, toluene, cyclohexane, benzene, and xylene; ethers such as ethylbenzyl ether, dibutyl ether, dipropyl ether, dibenzyl ether, dimethyl ether, tetrahydrofuran, vinyl methyl ether, and vinyl ethyl ether; ketones such as acetaldehyde, acetone, acetophenone, diisobutyl ketone, diisopropyl ketone, and cyclohexanone; esters such as ethyl formate, ethyl acetate, methyl acetate, ethyl stearate, and methyl salicylate; and water. The solvents are used to adjust the SP (solubility parameter) of the solvent system.

Examples of dispersing agents include polyvinyl pyrrolidone, polyvinyl alcohol, 1-hexadecanol, hydroxypropylcellulose, hydroxypropylmethyl (ethyl) cellulose, poly(12-hydroxystearic acid), poly(styrene-b-dimethylsiloxane), polyisobutylene, polyacrylic acid, polyacrylamide, polyvinyl acrylic ether, and polyethyleneimine. These dispersing agents may be used individually or in mixtures.

Examples of monomers include styrene acrylate, ethyl acrylate, n-butyl acrylate, iso-butyl acrylate, 2-ethylhexyl acrylate, cyclohexyl acrylate, tetrahydrofurfuryl acrylate, methyl methacrylate, ethyl methacrylate, n-butyl methacrylate, iso-butyl methacrylate, 2-ethylhexyl methacrylate, stearyl methacrylate, lauryl methacrylate, methyl vinyl ether, ethyl vinyl ether, n-propyl vinyl ether, iso-butyl vinyl ether, n-butyl vinyl ether, styrene, α-methylstyrene, acrylonitrile, methacrylonitrile, vinyl acetate, vinyl chloride, vinylidene chloride, vinyl fluoride, vinylidene fluoride, ethylene, propylene, isoprene, chloroprene, and butadiene. Monomers having functional groups such as carboxyl groups, hydroxyl groups, methylol groups, amino groups, acid amide groups, and glycidyl groups may also be mixed in with the aforementioned monomers. Examples of those having carboxyl groups include acrylic acid, methacrylic acid, and itaconic acid; examples of those having hydroxyl groups include β-hydroxyethyl acrylate, β-hydroxyethyl methacrylate, β-hydroxypropyl acrylate, β-hydroxypropyl methacrylate, and allyl alcohol; examples of those having methylol groups include N-methylol acrylamide and N-methylol methacrylamide; examples of those having amino groups include dimethylaminoethyl acrylate and dimethylaminoethyl methacrylate; examples of those having acid amide groups include acrylamide and methacrylamide; and those having glycidyl groups include glycidyl acrylate, glycidyl methacrylate, and glycidyl allyl ether. Monomers having hydrolyzable silyl groups, such as γ-methacryloxypropyl trimethoxysilane, vinyl triacetoxysilane, and vinyl trimethoxysilane, can also be used as monomer having the aforementioned functional groups. These monomers may be used individually or in mixtures.

Examples of initiators include azo-based hydrochloride systems such as 2,2'-azobis(2-methyl-N-phenylpropionamidine)dihydrochloride, 2,2'-azobis(N-(4-chlorophenyl)-2-methylpropionamidine)dihydrochloride, 2,2'-azobis(N-(4-hydroxyphenyl)-2-methylpropionamidine) dihydrochloride, 2,2'-azobis(N-(4-aminophenyl)-2-methylpropionamidine)tetrahydrochloride, 2,2'-azobis(2-methyl-N-(phenylmethyl)propionamidine)dihydrochloride, 2,2'-azobis(2-methyl-N-2-propenylpropionamidine) dihydrochloride, 2,2-azobis(2-methylpropionamidine) dihydrochloride, 2,2'-azobis(N-(2-hydroxyethyl)-2-methylpropionamidine)dihydrochloride, 2,2'-azobis((2-5-methyl-2-imidazolidin-2-yl)propane)dihydrochloride, 2,2'-azobis(2-(2-imidazolin-2-yl)propane)dihydrochloride, 2,2'-azobis(2-(4,5,6,7-tetrahydro-1H-1,3-diazepin-2-yl)propane) dihydrochloride, 2,2'-azobis(2-(3,4,5,6-tetrahydropyridin-2-yl)propane)dihydrochloride, 2,2'-azobis(2-(5-hydroxy-3,4,5,6-tetrahydropyridin-2-yl)propane)dihydrochloride, and 2,2'-azobis(2-(1-(2-hydroxyethyl)-2-imidazolin-2-yl) propane)dihydrochloride. Examples of other azo-based initiators include 2,2'-azobisisobutyronitrile, 2,2'-azobismethylbutyronitrile, 2,2'-azobis-2-cyclopropylpropionitrile, 2,2'-azobis-4-methoxy-2,4-dimethylvaleronitrile, 1,1'-azobiscyclohexane-1-carbonitrile, 2,2'-azobis(2,4-dimethyl)valeronitrile, 2-phenylazo-4-methoxy-2,4-dimethylvaleronitrile, and 2,2'-azobis-N,N'-dimethyleneisobutylamidine. Examples of organic peroxide initiators include benzoyl peroxide, methyl ethyl ketone peroxide, cumene hydroxyperoxide, t-butyl hydroperoxide, cyclohexanone peroxide, t-butyl peroxide, t-butyl peroxybenzoate, t-butyl peroxy-2-ethylhexanate, t-butyl peroxypivalate, t-butyl peroxyneodecanoate, 3,5,5-trimethylhexanoyl peroxide, diisopropyl benzene hydroperoxide, lauroyl peroxide, and dicumyl peroxide. These initiators may be used individually or in mixtures. The aforementioned solvents, dispersing agents, monomers, initiators, and the like are not limited to these.

The reactor equipped with the stirrer, condenser, thermometer, gas feed line, and the like is then filled with 1978.8 g methanol and 494.7 g isopropyl alcohol as solvent, and 102.0 g polyvinyl pyrrolidone K-30 is dissolved as the dispersing agent. 705.5 g styrene monomer and 144.5 g n-butyl acrylate monomer are then mixed in, and 51.0 g of the initiator α,α'-azobisisobutyronitrile is then dissolved therein.

The contents of the reactor containing the solution are then placed under nitrogen gas, and the solution is heated while stirred from 20 to 60° C. to bring about 13 hours of polymerization. When the reaction system is heated, the polymerization reaction begins, polymer particles are formed in the solution, and these polymer particles grow over time. Eight hours after the reaction system has reached 60° C. in the course of the reaction, 238.0 g of a 2.5:1 mixture of distilled water and methanol is added in the form of drops over 20 minutes, and after 12 hours, 476.0 g of the same mixture is again added in the form of drops over 40 minutes. After 10 hours, 68.0 g of a 1:3 mixture of divinyl benzene and methanol is added in the form of drops over 20 minutes.

Thirteen hours after the reaction system reaches 60° C., the reaction system is quenched to no more than 20° C. to conclude polymerization. The reaction solution is filtered off to remove the unneeded dispersing agent and monomer in the reaction liquid and to recover the polymer particles. The recovered polymer particles are dispersed in methanol and are filtered off again so as to wash the polymer particles. These operations are repeated as much as 5 times to obtain styrene and n-butyl acrylate copolymer particles with no impurities left over.

A Coulter Multisizer II (by Coulter) was used to measure the particle size distribution of such polymer particles, revealing a volume mean diameter of 6.9 μm. Filter paper with a retention particle diameter of 5 μm was thus used for filtration following dyeing.

The toner particles produced in the manner described above were colored with a dye. The dyeing was a treatment in which the toner particles were colored in a dye solution obtained by dispersing and dissolving a dye in a solvent, and the toner particles were then dried.

A specific example of a dyeing treatment is described below. For example, 850 g toner particles are dispersed in 4250 g dye solution and are stirred for 1 hour as the dye solution is heated to 30° C. After 1 hour, 850 g distilled water is mixed in, and the dispersion is filtered off. The filtered particles are dispersed in a 1:3 mixture of methanol and distilled water, and are again filtered off. The filtered particles are then dried.

Examples of dyes which can be used in the dye treatment include reactive dyes, disperse dyes, oxidation dyes, azoic dyes, basic dyes, acid dyes, mordant dyes, direct dyes, and vat dyes. An excess of black dye (Kayalon Polyester Black S-200, by Nippon Kayaku Co., Ltd.) is dissolved in methanol, the undissolved material is filtered off using a filter with a 0.45 μm retention particle diameter, and the resulting filtrate is used as the dye solution. In other words, it is a saturated methanol solution of black dye. The toner particles may be ultrasonically dispersed in the dye solution or the mixture of methanol and distilled water. In such cases, they tend to disperse into primary particles. Ultrasonic treatment may also be employed as the toner particles are dispersed in the dye solution and are stirred for 1 hour while heated to 30° C. This will promote better coloring.

The toner particles which have been colored in the manner described above are preferably subjected to surface treatment in which the surfaces of relatively large matrix particles (about 1 to 1000 μm) are coated with relatively small subsidiary particles (about 0.001 to 600 μm) by using mechanical force to embed, or by forming a film of the subsidiary particles on the matrix particles. Specifically, the following surface treatment may be carried out using the dyed toner particles as the matrix particles, for example. That is, 1 g acrylic fine powder (F-062, by Nippon Paint Co., Ltd.) is premixed with 100 g colored toner particles. The surface treatment is carried out using a hybridization system NSH-0 by Nara Kikai Seisakusho under the following conditions: rotor rpm: 13000 rpm (peripheral speed 80 m/sec); treatment time: 5 minutes; amount treated: 20 g at a time; and jacket cooling: tap water. As a result of the surface treatment, the acrylic fine powder adhering to the surfaces of the colored particles coats the surfaces, making the colored particles to be electrified and lowering the adhesion between particles. Toner particles with this surface modification are used as first virgin toner. The method used to produce such first virgin toner is referred to for the sake of convenience as the first toner manufacturing method.

A common method for pulverizing aggregated particles is used to render the aforementioned colored toner particles into primary particles by pulverizing the aggregates with enough impact to avoid pulverizing the aggregate into primary particles. Specifically, the pulverization is managed with the use of a hybridization system NSH-0 by Nara Kikai Seisakusho under the following conditions: rotor rpm: 13000 rpm (peripheral speed 80 m/sec); treatment time: 1 minute; amount treated: 20 g at a time; and jacket cooling: tap water. The pulverization treatment allows the aggregates to be pulverized without pulverizing the colored particles, resulting in primary particles. These pulverized particles are used as the second virgin toner. The method for producing the second virgin toner is referred to for the sake of convenience as the second toner manufacturing method.

The hydrophobic silica externally added to the toner particles acts as a fluidity-imparting agent which provides the toner with fluidity. Silica fine powder is used as the hydrophobic silica. The mean particle diameter is preferably several tens nm. The hydrophobic silica also is used preferably in an amount of between 0.1 and 3 weight parts per 100 weight parts toner particles.

The silicone fine particles similarly externally added to the toner particles have a mean particle diameter of preferably no more than 1.0 μm, more preferably about 0.5 μm, for example, and are preferably used in an amount of between 0.5 and 3 weight parts per 100 weight parts toner particles. Specific examples of silicone fine particles include Tospearl 105, 120, 130, 145, 3120, and 240 by Toshiba Silicone. These silicone fine particles have a reticulated structure in which the siloxane bonds are stretched three-dimensionally, with one methyl group bonded to one silicone atom. Other examples include Torafil by Toray Silicone, such as F-200, 201, 202, 203, 250, 300, 301, and 400, which have a silicone content of 60%, hydrophobically treated F-100 and 101 with a silicone content of 100%, R-900, 901, and 902 which have a three-dimensionally cross-linked reticulated structure, R-910 comprising small flakes of silicone resin containing few SiOH groups and an abundance of methyl groups, and the silicone rubber elastomers E-500, 501, 600 (methyl silicone), 601 (containing epoxy groups), 602 (containing amino groups), 603 (containing phenyl groups), and 850 (containing methyl groups). Examples of silicone fine particles which can be used in the embodiments are not limited to the silicone fine particles listed above. Various other silicone fine particles and fine particles containing silicone can also be used.

A method for externally adding the aforementioned hydrophobic silica and silicone fine particles to the toner particles is to introduce the toner particles, hydrophobic silica and silicone fine particles into a mixer (Mechanomill, by Okada Seiko), and to mechanically mix them at a predetermined rpm for a predetermined mixing time.

The dry-development toner according to the second present invention will now be described with reference to a specific embodiment of the second present invention.

The dry-development toner according to this embodiment is basically obtained by additionally coating the surfaces of resin particles having been colored with a dye with a fine organic powder having a mean particle diameter of 0.8 μm or less by means of mechanical impact force.

Polymerized particles prepared by dispersion polymerization, suspension polymerization, emulsion polymerization, emulsion polymerization and aggregation, seed polymerization, and other methods can be used in this case as resin particles. Of these, polymerized resin particles obtained by dispersion polymerization are particularly preferred. Dispersion polymerization is a method in which solvent is introduced into a polymerization reaction container, materials such as monomers, dispersing agents, and initiators are also introduced and dissolved, the contents of the container are placed under inert nitrogen gas, the reaction system in the container is heated as the solution is agitated, the particle dispersion is separated into solids and liquids following several hours to some tens of hours of polymerization, and the solid particles are recovered to obtain resin particles.

A specific method for producing resin particles by dispersion polymerization is described below. To manufacture resin particles by dispersion polymerization, a reactor equipped with an agitator, condenser, thermometer, gas feed tube, and the like is filled with solvent, and a dispersing agent is dissolved therein. Monomer is then mixed therein, and an initiator and a cross-linking agent are also dissolved.

Examples of solvents include alcohols such as methanol, ethanol, n-butanol, s-butanol, t-butanol, n-amyl alcohol, s-amyl alcohol, t-amyl alcohol, isoamyl alcohol, isobutyl alcohol, isopropyl alcohol, 2-ethylbutanol, 2-ethylhexanol, 2-octanol, n-octanol, n-decanol, cyclohexanol, n-hexanol, 2-heptanol, 3-heptanol, 3-pentanol, methyl cyclohexanol, 2-methyl-2-butanol, 3-methyl-2-butanol, 3-methyl-1-butyn-3-ol, 4-methyl-2-pentanol, and 3-methyl-1-pentyn-3-ol, which can be used either individually or in combinations of two or more. Examples of organic solvents used with such alcohols include hydrocarbons such as hexane, toluene, cyclohexane, benzene, and xylene; ethers such as ethylbenzyl ether, dibutyl ether, dipropyl ether, dibenzyl ether, dimethyl ether, tetrahydrofuran, vinyl methyl ether, and vinyl ethyl ether; ketones such as acetaldehyde, acetone, acetophenone, diisobutyl ketone, diisopropyl ketone, and cyclohexanone; esters such as ethyl formate, ethyl acetate, methyl acetate, ethyl stearate, and methyl salicylate; and water. The solvents, among other things, are used to adjust the SP (solubility parameter) of the reaction system.

Examples of dispersing agents include polyvinyl pyrrolidone, polyvinyl alcohol, polyethyleneimine, hydroxypropyl cellulose, hydroxypropyl methyl(ethyl)cellulose, poly(12-hydroxystearic acid), poly(styrene-b-dimethylsiloxane), polyisobutylene, polyacrylic acid, polyacrylic acid esters, polymethacrylic acid, polymethacrylic acid esters, and 1-hexadecanol. Of these dispersing agents, polyvinylpyrrolidone and combinations of polyvinylpyrrolidone and 1-hexadecanol are preferably used to ensure that the resulting resin particles have uniform diameters and a narrow particle size distribution.

Examples of monomers include styrene, vinyl toluene, α-methylstyrene, and other aromatic vinyls; methyl methacrylate, ethyl methacrylate, 2-ethylhexyl methacrylate, and other methacrylic acid esters; methyl acrylate, ethyl acrylate, butyl acrylate, ethylhexyl acrylate, and other acrylic acid esters; vinyl formate, vinyl acetate, vinyl propionate, and other vinyl esters; vinyl methyl ether, vinyl ethyl ether, and other vinyl ethers; methacrylic acid, acrylic acid, maleic anhydride, and metal salts thereof; diethylaminoethyl methacrylate, diethylaminoethyl acrylate, and other monomers having functional groups; and trifluoroethyl methacrylate, tetrafluoropropyl methacrylate, and other fluorine-containing monomers. In this case, the resin particles used as binder particles for a toner are preferably highly translucent if they are to be used in overhead projectors. Good insulation properties are also required in order to obtain adequately developed images. Furthermore, high mechanical strength is needed at elevated temperatures to prevent the particles from breaking up inside the development apparatus, and the particles are preferably able to soften and to adhere to the recording medium without requiring large amounts of thermal energy in order to achieve adequate fixing properties. Taking these considerations into account, is it particularly suitable to use a copolymer in which the monomer is one or more of styrene, an acrylic acid ester, or a methacrylic acid ester when the resin particles are to be used as binder particles for toner.

Examples of initiators include azo-based hydrochloride systems such as 2,2'-azobis(2-methyl-N-phenylpropionamidine)dihydrochloride, 2,2'-azobis(N-(4-chlorophenyl)-2-methylpropionamidine)dihydrochloride, 2,2'-azobis(N-(4-hydroxyphenyl)-2-methylpropionamidine) dihydrochloride, 2,2'-azobis(N-(4-aminophenyl)-2-methylpropionamidine)tetrahydrochloride, 2,2'-azobis(2-methyl-N-(phenylmethyl)propionamidine)dihydrochloride, 2,2'-azobis(2-methyl-N-2-propenylpropionamidine) dihydrochloride, 2,2'-azobis(2-methylpropionamidine) dihydrochloride, 2,2'-azobis(N-(2-hydroxyethyl)-2-methylpropionamidine)dihydrochloride, 2,2'-azobis((2-5-methyl-2-imidazolin-2-yl)propane)dihydrochloride, 2,2'-azobis(2-(2-imidazolin-2-yl)propane)dihydrochloride, 2,2'-azobis(2-(4,5,6,7-tetrahydro-1H-1,3-diazepin-2-yl)propane) dihydrochloride, 2,2'-azobis(2-(3,4,5,6-tetrahydropyridin-2-yl)propane)dihydrochloride, 2,2'-azobis(2-(5-hydroxy-3,4,5,6-tetrahydropyridin-2-yl)propane)dihydrochloride, and 2,2'-azobis(2-(1-(2-hydroxyethyl)-2-imidazolin-2-yl) propane)dihydrochloride. Examples of other azo-based initiators include 2,2'-azobisisobutyronitrile, 2,2'-azobismethylbutyronitrile, 2,2'-azobis-2-cyclopropylpropionitrile, 2,2'-azobis-4-methoxy-2,4-dimethylvaleronitrile, 1,1'-azobiscyclohexane-1-carbonitrile, 2,2'-azobis(2,4-dimethyl)valeronitrile, 2-phenylazo-4-methoxy-2,4-dimethylvaleronitrile, and 2,2'-azobis-N,N'-dimethyleneisobutylamidine. Examples of organic peroxide initiators include benzoyl peroxide, methyl ethyl ketone peroxide, cumene hydroxyperoxide, t-butyl hydroperoxide, cyclohexanone peroxide, t-butyl peroxide, t-butyl peroxybenzoate, t-butyl peroxy-2-ethylhexanate, t-butyl peroxypivalate, t-butyl peroxyneodecanoate, 3,5,5-trimethylhexanoyl peroxide, diisopropyl benzene hydroperoxide, lauroyl peroxide, and dicumyl peroxide. These initiators may be used individually or as mixtures of a plurality of initiators.

Examples of cross-linking agents include divinylbenzene, ethylene glycol di(meth)acrylate, butanediol di(meth) acrylate, trimethylol propane (tri)methacrylate, and pentaerythritol tri(meth)acrylate. Of these cross-linking agents, it is preferable to use divinylbenzene and ethylene glycol di(meth)acrylate, considering that a copolymer in which the monomer is a mixture of styrene and one or more of acrylic acid esters or methacrylic acid esters is used during the polymerization of resin particles.

The polymerization reaction in the aforementioned reaction system is subsequently completed, the reaction solution is then filtered off, unneeded dispersing agents or monomers are removed from the reaction solution, and resin particles are recovered. The resin particles thus recovered are washed by being first dispersed in a solvent and then filtered off. This operation is repeated from one to five times, yielding resin particles devoid of residual impurities.

The resin particles thus produced are subsequently dyed with a dye. Dyeing is performed by drying the resin particles after coloring them in a dye liquor obtained by dispersing or dissolving a dye in a solvent.

Here, examples of dyes that can be used for dyeing include black dyes such as Kayaset Black K-R, A-N, Kayalon Polyester Black S-200, EX-SF 300, G-SF, BR-SF, 2B-SF 200, TA-SF 200, AUL-S, and other dyes manufactured by Nippon Kayaku Co., Ltd.; Valifast Black 3806, 3810, 3820, Oil Black BS, BY, B-85, 860, and other dyes manufactured by Orient Kagaku Kogyo Co., Ltd.; Sumikaron Black S-BL, S-BF extra conc., S-RPD, S-XE 300%, and other dyes manufactured by Sumitomo Chemical Co., Ltd.; Basacryl Black X-BGW, Naozapon Black X-51, X-55, and other dyes manufactured by BASF; Oleosol Fast Black AR, RL, and other dyes manufactured by Taoka Chemical Co., Ltd.; Spilon Black BNH, MH special, and other dyes manufactured by Hodogaya Chemical Co., Ltd.; and Orasol Black RLI, RL, CN, and other dyes manufactured by Ciba.

Examples of yellow dyes include Kayaset Yellow K-CL, Kayalon Polyester Yellow 4G-E, Kayalon Polyester Light Yellow 5G-S, and other dyes manufactured by Nippon Kayaku Co., Ltd.; Water Yellow 6C, Valifast Yellow 1101, 1105, 3110, 3120, 4120, 4126, Oplas Yellow 130, 140, Oil Yellow GG-S, 105, 107, 129, 818, and other dyes manufactured by Orient Kagaku Kogyo Co., Ltd.; Sumikaron Yellow SE-4G, SE-5G, SE-3GL conc., SE-RPD, Sumikaron Brilliant Flavine S-10G, and other dyes manufactured by Sumitomo Chemical Co., Ltd.; Neozapon Yellow 081, Lurafix Yellow 138. and other dyes manufactured by BASF; Oleosol Fast Yellow 2G and other dyes manufactured by Taoka Chemical Co., Ltd.; Oracet Yellow 8GF, GHS, and other dyes manufactured by Ciba; PS Yellow GG, MS Yellow HD-180, and other dyes manufactured by Mitsui Toatsu Chemicals, Inc.; and TS Yellow 118 cake, ESC Yellow 155, Sumiplast Yellow HLR, GC, and other dyes manufactured by Sumika Color Co., Ltd.

Examples of magenta dyes include Kayaset Red K-BL, Kayacelon Red E-BF, SMS-5, SMS-12, Kayalon Polyester Red TL-SF, BR-S, BL-E, HL-SF, 3BL-S200, AUL-S, Kayalon Polyester Light Red B-S200, Kayalon Polyester Rubine BL-S200, and other dyes manufactured by Nippon Kayaku Co., Ltd.; Water Red 27, Valifast Red 1306, 1355, 2303, 3311, 3320, Valifast Orange 3210, Valifast Brown 2402, Oil Red 5B, Oil Pink 312, Oil Brown BB, and other dyes manufactured by Orient Kagaku Kogyo Co., Ltd.; Sumikaron Red E-FBL, E-RPD(E), S-RPD(S), Sumikaron Brilliant Red S-BF, S-BLF, SE-BL, SE-BGL, SE-2BF, SE-3BL (N), and other dyes manufactured by Sumitomo Chemical Co., Ltd.; Zapon Red 395, 471, Neozapon Pink 478, Lurafix Red 420, 430, and other dyes manufactured by BASF; Oleosol Fast Pink FB, Rhodamine A, B, B gran., and other dyes manufactured by Taoka Chemical Co., Ltd.; Ceres Red 3R, Macrolex Red Violet R, and other dyes manufactured by Bayer; Orasol Red G, Oracet Pink RP, and other dyes manufactured by Ciba; PS Red G, MS Magenta VP, and other dyes manufactured by Mitsui Toatsu Chemicals, Inc.; ESC Bordeaux 451, Sumiplast Violet B, RR, Sumiplast Red FB, 3B, B-2, HF4G, AS, HL5B, Sumiplast Orange HRP, and other dyes manufactured by Sumika Color Co., Ltd.

Examples of cyan dyes include Kayaset Blue N, K-FL, MSB-13, Kayalon Polyester Blue BR-SF, T-S, Kayalon Polyester Light Blue BGL-S200, Kayalon Polyester Turq Blue GL-S200, Kayalon Polyester Blue Green FCT-S, and other dyes manufactured by Nippon Kayaku Co., Ltd.; Valifast Blue 1601, 1603, 1605, 2606, 3806, 3820, Oil Blue No. 15, No. 613, 613, N14, BOS, and other dyes manufactured by Orient Kagaku Kogyo Co., Ltd.; Sumikaron Brilliant Blue S-BL, Sumikaron Turquoise Blue S-GL, S-GLF grain, and other dyes manufactured by Sumitomo Chemical Co., Ltd.; Zapon Blue 807, Neozapon Blue 807, Lurafix Blue 590, 660, and other dyes manufactured by BASF; Oleosol Fast Blue ELN and other dyes manufactured by Taoka Chemical Co., Ltd.; Ceres Blue GN 01 and other dyes manufactured by Bayer; Orasol Blue GL, GN, 2R, and other dyes manufactured by Ciba; and TS Turq Blue 618, 606, ESC Blue 655, 660, Sumiplast Blue S, OA, and other dyes manufactured by Sumika Color Co., Ltd.

As described above, the dyeing of the resin particles is followed by a treatment in which a fine organic powder with a mean particle diameter of 0.8 $\mu$m or less is embedded into the surfaces of these resin particles by means of mechanical impact force. Such embedding can be performed using a hybridization system, for example. In addition, a fine acrylic resin powder, fine fluororesin powder, fine silicon-based resin powder, or other fine powder may be used as the fine organic powder. Examples of fine acrylic resin powders include MP-1000, 1100, 1201, 1220, 1400, 1401, 1450, 1451, 2701, 3100, 4009, 4951, and other powders manufactured by Soken Kagaku Co., Ltd., as well as 4146, 4149, N-30, 32, 70, 300, 400, F-052, 062, and other powders manufactured by Nippon Paint Co., Ltd. Examples of fine fluororesin powders include Luvulon L-5, L-5F, L-2, and other powders manufactured by Daikin Industries, Ltd. Tospearl 105, which is manufactured by Toshiba Silicone Co., Ltd., is an example of a fine silicon-based resin powder It is also possible to use melamine-formaldehyde condensates (for example, the Epostar-S and S6 manufactured by Nippon Shokubai Co., Ltd.).

After a fine organic powder has been embedded to the resin particles in such a manner, a fine hydrophobic inorganic powder is externally added to the resin particles. For example, silica, aluminum oxide, or titanium oxide can be used as the fine hydrophobic inorganic powder. Here, the fine hydrophobic inorganic powder acts as a fluidizing agent for imparting fluidity to the toner. The mean particle diameter of this fine hydrophobic inorganic powder is preferably several tens of nanometers, and the amount thereof externally added is preferably 1 to 3 weight parts per 100 weight parts of resin particles.

EXAMPLES

Examples of toners of the first present invention will now be described.

In the following working and comparative examples, the first virgin toner obtained by the first toner manufacturing method described above and the second virgin toner obtained by the second toner manufacturing method are used as a base to prepare toner by externally adding hydrophobic silica and silicone fine particles to the toner particles. An example using the first virgin toner as the base is described first.

Example 1

To the first virgin toner obtained by the first toner manufacturing method, externally added hydrophobic silica and silicone fine particles using the following formulation.

| | |
|---|---|
| First virgin toner | 100 weight parts |
| Hydrophobic silica (H-2000, by Wacker) | 1 weight part |
| Silicone fine particles (Tospearl 105, by Toshiba Silicone) | 3 weight parts |

These were introduced into a Mechanomill by Okada Seiko and were mixed for 3 minutes at 2750 rpm, thereby performing the external addition of the hydrophobic silica and silicone fine particles to first virgin toner. The externally added toner was sifted with a sieve having 38 $\mu$m openings to remove the coarse powder, resulting in a final toner 1.

Comparative Example 1

To the first virgin toner, externally added only hydrophobic silica in the same manner as in Example 1 using the following formulation.

| | |
|---|---|
| First virgin toner | 100 weight parts |
| Hydrophobic silica (H-2000, by Wacker) | 1 weight part |

In the same manner as in Example 1, these were introduced into a Mechanomill by Okada Seiko and were mixed for 3 minutes at 2750 rpm, thereby performing the external addition of the hydrophobic silica to the first virgin toner with. The coated toner was sifted with a sieve having 38 $\mu$m openings to remove the coarse powder, resulting in a final toner 2. To Toner 2, silicone fine particles were not externally added.

A Microline 600 CL process cartridge by Oki Data was filled with the toners 1 and 2 prepared above, images were formed, and the solid density and fogging density of the images were measured. The results are given in FIG. 1. FIG. 1 is a table comparing the solid density and fogging density relative to the amount of silicone fine particles (Tospearl) be externally added to the toner particles of toners 1 and 2. The amount of the silicone fine particles is given in weight parts in FIG. 1.

The solid density and fogging density of the images were measured using a reflection density meter (aperture diameter: 2 mm) by Macbeth. A solid density of 1.1 or more was considered acceptable, while a fogging density of no more than 0.3 was considered acceptable.

In the table in FIG. 1, toner 1, to which 3 weight parts silicone fine particles were externally added, had a solid density of 1.41, which was in the acceptable range, and a fogging density of 0.10, which was also in the acceptable range. Toner 2 had a solid density of 1.43, which was in the acceptable range, but had a fogging density of 0.42, which was outside the acceptable range. The difference in the fogging density values was attributed to the presence or absence of the external addition of the silicone fine particle. Toner 1 was coated with silicone fine particles, resulting in images with dramatic improvement in fogging and better contrast.

An example in which toner is prepared using the aforementioned second virgin toner as a base is described below.

Example 2

To the second virgin toner obtained by the second toner manufacturing method, externally added hydrophobic silica and silicone fine particles using the following formulation.

| | |
|---|---|
| Second virgin toner | 100 weight parts |
| Hydrophobic silica (H-2000, by Wacker) | 3 weight parts |
| Silicone fine particles (Tospearl 105, by Toshiba Silicone) | 0.5 weight part |

In the same manner as in Example 1, these were introduced into a Mechanomill by Okada Seiko and were mixed for 3 minutes at 2750 rpm, thereby performing the external addition of the hydrophobic silica and silicone fine particles to the second virgin toner. The externally added toner was sifted with a sieve having 38 $\mu$m openings to remove the coarse powder, resulting in a final toner 3.

Example 3

In the same manner as in Example 2, to the second virgin toner obtained by the second toner manufacturing method, externally added hydrophobic silica and silicone fine particles using the following formulation.

| | |
|---|---|
| Second virgin toner | 100 weight parts |
| Hydrophobic silica (H-2000, by Wacker) | 3 weight parts |
| Silicone fine particles (Tospearl 105, by Toshiba Silicone) | 1 weight part |

In the same manner as In Example 1, these were introduced into a Mechanomill by Okada Seiko and were mixed for 3 minutes at 2750 rpm, thereby performing the external addition of the hydrophobic silica and silicone fine particles to the second virgin toner. The externally added toner was sifted with a sieve having 38 $\mu$m openings to remove the coarse powder, resulting in a final toner 4.

Example 4

In the same manner as in Example 2, to the second virgin toner obtained by the second toner manufacturing method, externally added hydrophobic silica and silicone fine particles using the following formulation.

| | |
|---|---|
| Second virgin toner | 100 weight parts |
| Hydrophobic silica (H-2000, by Wacker) | 3 weight parts |
| Silicone fine particles (Tospearl 105, by Toshiba Silicone) | 3 weight parts |

In the same manner as in Example 1, these were introduced into a Mechanomill by Okada Seiko and were mixed for 3 minutes at 2750 rpm, thereby performing the external addition of the hydrophobic silica and silicone fine particles to the second virgin toner. The externally added toner was sifted with a sieve having 38 $\mu$m openings to remove the coarse powder, resulting in a final toner 5.

Comparative Example 2

In the same manner as in Example 2, to the second virgin toner obtained by the second toner manufacturing method, externally added only hydrophobic silica using the following formulation.

| | |
|---|---|
| Second virgin toner | 100 weight parts |
| Hydrophobic silica (H-2000, by Wacker) | 3 weight parts |

In the same manner as in Example 1, these were introduced into a Mechanomill by Okada Seiko and were mixed for 3 minutes at 2750 rpm, thereby performing the external addition of the hydrophobic silica to the second virgin toner. The externally added toner was sifted with a sieve having 38 $\mu$m openings to remove the coarse powder, resulting in a final toner 6.

The toners in Examples 2 through 4 and Comparative Example 2 prepared as described above were used in the image-forming device depicted in FIG. 3 to form images. FIG. 3 is a schematic of the structure of the image-forming device, where a cylindrical back face electrode roller 22 is rotatable supported by the main unit frame not shown in the figure at a gap of about 1 mm above an aperture electrode 1 serving as the electrode array, and printing paper 20 inserted into the aforementioned gap is conveyed in the direction indicated by the arrow in the figure. High voltage is applied through a DC power source 24 to the back face electrode roller 22.

A toner supply device 10 is disposed underneath the aperture electrode 1, and a conveying roller 29 for conveying the printing paper 20 between the aperture electrode 1 and back face electrode roller 22 is disposed on the side where the printing paper 20 is fed in. Fixing devices 26 are disposed at the leading end in the direction in which the printing paper 20 conveyed by the back face electrode roller 22 advances, and are supported by the main unit frame.

The toner supply device 10 is composed of a toner case 11 which serves as housing, toner 16 housed in the toner case 11, a supply roller 12, a toner holding roller 14, and a toner layer regulating blade 18.

The aforementioned toner holding roller 14 holds the charged toner 16 in the form of a layer on the surface and conveys it toward the aperture electrode 1, and the aforementioned supply roller 12 supplies the toner 16 to the surface of the toner holding roller 14.

The supply roller 12 and toner holding roller 14 are rotatably supported in the direction indicated by the arrow in the figure inside the toner case 11. The two are also disposed so as to come into contact with each other. The toner layer regulating blade 18 is used to adjust the amount of toner 16 held by the toner holding roller 14 so that the toner is more uniform on the roller surface, and also to statically charge the toner 16 in a uniform manner. The blade is in contact under pressure with the toner holding roller 14.

In the aforementioned aperture electrode 1, a plurality of apertures (not shown in the figure) perforating a 25 $\mu$m thick polyimide insulating sheet 2 are equidistantly disposed linearly in the insulating sheet 2, and control electrodes (not shown in the figure) are formed of copper foil around the apertures on the top side of the insulating sheet. A plurality of driver IC 5 for applying the prescribed voltage to the control electrodes are also disposed at the end of the insulating sheet 2. As shown in FIG. 3, the aperture electrode 1 is disposed so as to come into contact with the toner 16 on the toner holding roller 14 at the apertures located in the insulation sheet 2 under the condition in which the control electrodes are faced to the printing paper.

When images are formed with the aforementioned image-forming device, image data signals based on the prescribed image data are sent from the control voltage-applying circuit 8 to the IC 5, and voltage signals for selectively turning the control electrodes of the aperture electrode 1 on and off are thus applied through the IC 5. Electrical power from the control electrodes to the toner holding roller 14 are formed by these operations, and the statically charged toner 16 is drawn from the toner holding roller 14 through the apertures to the control electrode side. The toner 16 is projected toward the printing paper 20 by the electric field that has been formed by the voltage applied to the back face electrode roller 22 between the printing paper 20 and the aperture electrode 1. The toner 16 thus projected onto the printing paper 20 accumulates on the printing paper 20 and forms images.

Images were formed using the toners of the aforementioned Examples 2 through 4 and Comparative Example 2 as the toner 16 in the image-forming device constructed in the manner described above, and the images thus formed were measured for toner projection rate, solid density, and fogging density. The results are given in FIG. 2 which is a table comparing the amount of silicone fine particles (Tospearl) externally added in the toners 3 through 6, the projection rate, the solid density, and the fogging density. The amounts in which the silicone fine particles were externally added is given in weight parts in FIG. 2.

The projection rate was calculated in the following manner. That is, the amount of toner held per unit surface area on the holding roller was first measured. Solid black was then printed at a control voltage of +70 V, and the amount of toner per unit surface area of the printing paper was then measured. Based on the measured results, the projection rate was calculated by dividing the amount of toner per unit surface area on the printing paper by the amount of toner per unit surface area on the holding roller. A projection rate of at least 60% was considered acceptable. The solid density and fogging density of the images were calculated in the same manner as in Example 1 above.

In the table in FIG. 2, toner 3, to which 0.5 weight part silicone fine particles were externally added, had a projection rate of 59.21%, which was roughly an acceptable value, a fogging density of 0.12, which was quite acceptable, and a solid density of 1.14, which was the minimum acceptable value. Toner 4, to which 1.0 weight part silicone fine particles were externally added, had a projection rate of 75.59%, a fogging density of 0.17, and a solid density of 1.35, all of which were quite acceptable and were all better than those for toner 3. Toner 5, to which 3.0 weight part silicone fine particles were externally added, had a projection rate of 90.67%, a fogging density of 0.25, and a solid density of 1.47, all of which were acceptable. The projection rate in particular was even higher than that of toner 4. It was thus evident that in toners 3 through 5, to which 0.5 to 3.0 weight parts silicone fine particles externally added, the contrast could be improved by maintaining a high image density while controlling image fogging, and that the projection rate of the toner onto printing paper could be improved. The projection rate improved proportionally to the amount of silicone fine particles externally added to the toner.

In contrast, toner 6, to which silicone fine particles were externally added, had a projection rate of 38.90%, which was far below the acceptable value, an acceptable fogging density of 0.09, but an unacceptable solid density of 0.92. The differences were attributed to the lack of a silicone fine particle coating.

The first present invention is not limited to the aforementioned Examples and is, of course, capable of a variety of modifications and variations within the scope of the first present invention.

As described above, in the toner of the first present invention, silicone fine particles are used as an external additive, which thus allows the contrast to be improved by maintaining a high image density while controlling image fogging during various image forming processes, and also allows the projection rate of the toner on the printing paper to be improved.

Examples of dry-development toners of the second present invention will now be described.

Example 5

1. Polymerization Step (Manufacture of Resin Particles)

The following components were introduced into and dissolved in a reaction apparatus equipped with a stirrer, a condenser, a thermometer, and a gas feed line:

| | |
|---|---|
| Methanol | 218 weight parts |
| 2-Propanol | 73 weight parts |
| Polyvinyl pyrrolidone (K-30) | 12 weight parts |
| Styrene | 77 weight parts |
| n-Butyl acrylate | 23 weight parts |
| α,α'-Azobisisobutyronitrile | 6 weight parts |

The reaction mixture was heated to 60° C. while agitated at 100 rpm and purged with nitrogen gas introduced through the gas feed line. Divinyl benzene was introduced in an amount of 2 weight parts after polymerization had been conducted for 11 hours, the polymerization process was continued for another 2 hours, the system was then cooled, and the polymerization reaction was stopped. The resulting resin particles were filtered off, recovered, washed with methanol, and dried by being allowed to stand for 48 hours at room temperature, yielding resin particles. The diameters of these resin particles were measured by a Coulter counter (manufactured by Coulter Co., Ltd.), and the volume mean diameter was found to be 7.0 $\mu$m.

2. Dyeing Step (Manufacture of Dyed Particles)

The resin particles thus obtained were dyed as described below.

The aforementioned resin particles were dispersed in an amount of 1 weight part in 5 weight parts of a saturated methanol solution of the dye Kayalon Polyester Black S-200 (manufactured by Nippon Kayaku Co., Ltd.), and the system was then agitated for 1 hour at a temperature of 30° C. to dye the particles. Furthermore, to remove excess dye, the dyed resin particles were washed with a water/methanol mixed solution in a ratio of 4 weight parts of solution per weight part of dyed resin particles. The particles were then filtered off, recovered, and dried by being allowed to stand for 48 hours at room temperature, yielding dyed particles. The diameters of these dyed particles were measured by the aforementioned Coulter counter, and the volume mean diameter was found to be 7.0 μm.

3. Embedding and Externally Adding Steps (Toner Manufacture)

A fine organic powder N-30 (particle diameter: 0.08 μm; manufactured by Nippon Paint Co., Ltd.) was embedded in an amount of 5 weight parts into the aforementioned dyed particles (used in an amount of 100 weight parts) with the aid of the hybridization system NSH-0 (manufactured by Nara Kikai Seisakusho) for 1 minute at a rotational speed of 16200 rpm to coat the surfaces of the dyed particles. Hydrophobic silica (HDK H2000, manufactured by Wacker Co., Ltd.), used in an amount of 3 weight parts, was agitated and mixed using a mechanical mill (manufactured by Okada Seiko Co., Ltd.) with 100 weight parts of the dyed particles obtained by the coating of the fine organic powder, yielding a toner externally added with the hydrophobic silica (toner A). The particle diameter of toner A was measured by the aforementioned Coulter counter, and the volume mean diameter was found to be 7.4 μm.

Figure 4:
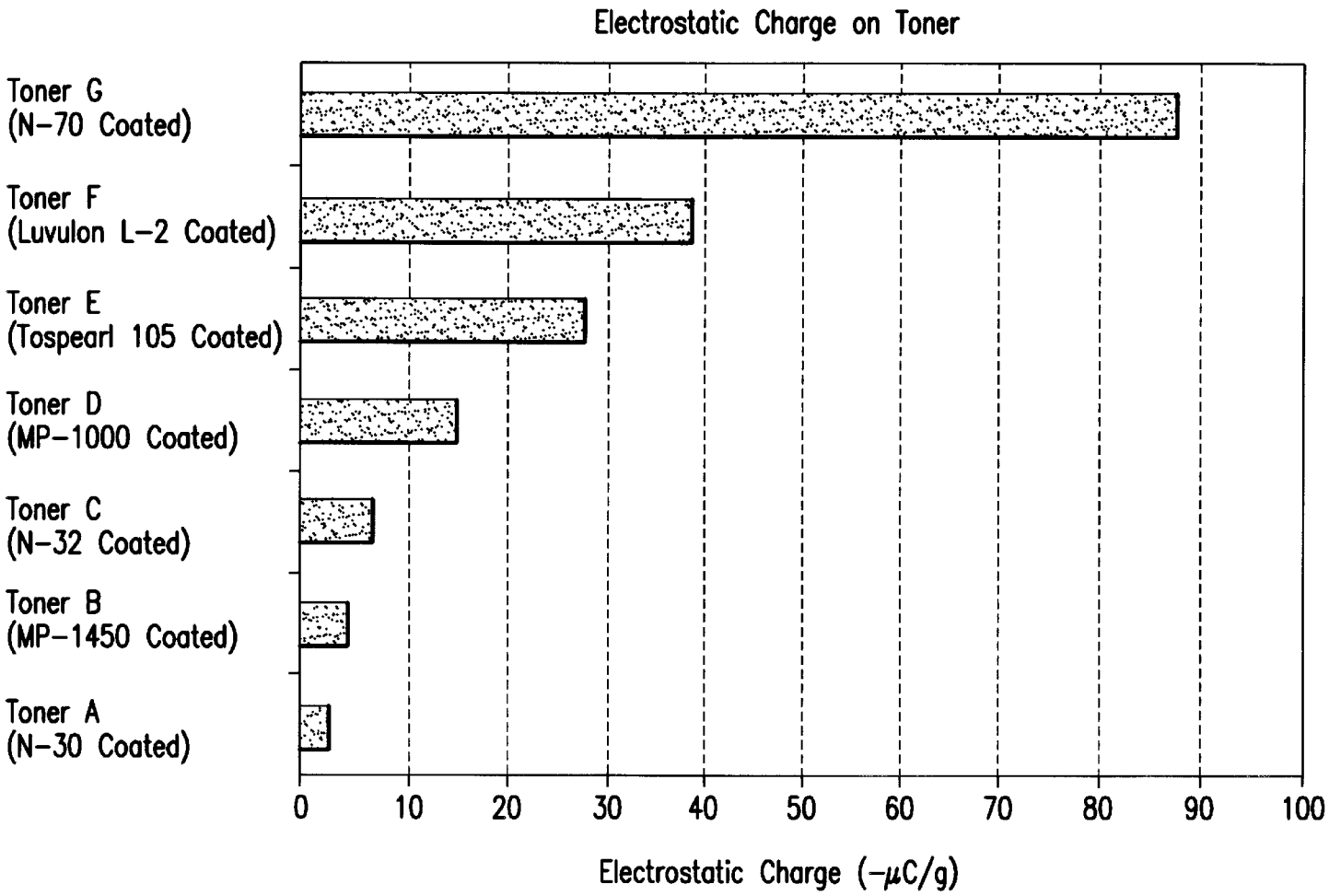
FIG. 4 is a graph depicting the static charge of toners A through G.

The resulting toner A and a charge carrier (BM-5) were mixed in amounts of 1 and 24 weight parts, respectively, and the static charge was measured using a blow-off powder charge measuring instrument (manufactured by Toshiba Chemical Co., Ltd.) and was found to be −2.0 μC per gram. The measurement results are shown in FIG. 4.

The toner cartridge of a commercially available laser printer (Microline 600CL, manufactured by Oki Electric Industry Co., Ltd.) was filled with toner A, images were formed on printing paper, and the offsetting of the images and the force with which they were fixed to the printing paper were evaluated.

Here, the fixing strength was evaluated in the following manner. Black solid printing and fixing were first performed using the aforementioned printer, and the transmission density of the black solid portions was measured using a Macbeth transmission densimeter. The black solid-printed surface was subsequently rubbed five times with white cotton on a rubbing tester RT-200 (manufactured by Daiei Kagaku Seiki Seisakusho Co., Ltd.), and the transmission density of the black solid-printed surface was then measured for a second time. Fixing strength was evaluated by comparing the transmission density of the black solid-printed surface before and after it had been rubbed with white cotton. In addition, image offsetting was visually evaluated.

FIG. 5 shows the results of the aforementioned evaluation of fixing strength, according to which the transmission density of the black solid-printed surface was 3.45 before rubbing and 3.46 after rubbing for toner A. Thus, the difference in transmission density was virtually nonexistent (−0.01), indicating that adequate fixing strength had been achieved. Furthermore, no offsetting was observed.

Example 6

After dyed particles had been obtained in the same manner as in Example 5, fine organic powder MP-1450 (particle diameter: 0.25 μm; manufactured by Soken Kagaku Co., Ltd.) was embedded in an amount of 5 weight parts per 100 weight parts of the dyed particles, and to the product, externally added 3 weight parts of the above-described hydrophobic silica, yielding toner B.

Toner B was measured in the same manner as above, and it was found that the volume mean diameter thereof was 7.8 μm; the static charge, −3.1 μC per gram (see FIG. 4). In addition, the fixing strength and offsetting state of toner B were measured and evaluated in the same manner as in Example 5, and it was found that the transmission density of the black solid-printed surface was 2.69 before rubbing and 2.68 after rubbing, as shown in FIG. 5. Thus, the difference in transmission density was virtually nonexistent (+0.01), indicating that adequate fixing strength had been achieved. Furthermore, no offsetting was observed.

Example 7

After dyed particles had been obtained in the same manner as in Example 5, fine organic powder N-32 (particle diameter: 0.08 μm; manufactured by Nippon Paint Co., Ltd.) was embedded in an amount of 5 weight parts per 100 weight parts of the dyed particles, and to the product, externally added 3 weight parts of the above-described hydrophobic silica, yielding toner C.

Toner C was measured in the same manner as above, and it was found that the volume mean diameter thereof was 7.3 μm; the static charge, −5.5 μC per gram (see FIG. 4). In addition, the fixing strength and offsetting state of toner C were measured and evaluated in the same manner as in Example 5, and it was found that the transmission density of the black solid-printed surface was 3.26 before rubbing and 3.28 after rubbing, as shown in FIG. 5. Thus, the difference in transmission density was virtually nonexistent (−0.02), indicating that adequate fixing strength had been achieved. Furthermore, no offsetting was observed.

Example 8

After dyed particles had been obtained in the same manner as in Example 5, fine organic powder MP-1000 (particle diameter: 0.4 μm; manufactured by Soken Kagaku Co., Ltd.) was embedded in an amount of 5 weight parts per 100 weight parts of the dyed particles, and to the product, externally added 3 weight parts of the above-described hydrophobic silica, yielding toner D.

Toner D was measured in the same manner as above, and it was found that the volume mean diameter thereof was 7.9 μm; the static charge, −15.0 μC per gram (see FIG. 4). In addition, the fixing strength and offsetting state of toner D were measured and evaluated in the same manner as in Example 5, and it was found that the transmission density of the black solid-printed surface was 2.49 both before and after rubbing, as shown in FIG. 5. Thus, the difference in transmission density was virtually nonexistent (±0.00), indicating that adequate fixing strength had been achieved. Furthermore, no offsetting was observed.

Example 9

After dyed particles had been obtained in the same manner as in Example 5, fine organic powder Tospearl 105 (particle diameter: 0.5 μm; manufactured by Toshiba Silicone Co., Ltd.) was embedded in an amount of 5 weight parts per 100 weight parts of the dyed particles, and to the product, externally added 3 weight parts of the above-described hydrophobic silica, yielding toner E.

Toner E was measured in the same manner as above, and it was found that the volume mean diameter thereof was 8.0

μm; the static charge, −27.2 μC per gram (see FIG. 4). In addition, the fixing strength and offsetting state of toner E were measured and evaluated in the same manner as in Example 5, and it was found that the transmission density of the black solid-printed surface was 2.98 both before and after rubbing, as shown in FIG. 5. Thus, the difference in transmission density was virtually nonexistent (±0.00), indicating that adequate fixing strength had been achieved. Furthermore, no offsetting was observed.

Example 10

After dyed particles had been obtained in the same manner as in Example 5, fine organic powder Luvulon L-2 (particle diameter: 0.3 μm; manufactured by Daikin Industries, Ltd.) was embedded in an amount of 5 weight parts per 100 weight parts of the dyed particles, and to the product, externally added 3 weight parts of the above-described hydrophobic silica, yielding toner F.

Toner F was measured in the same manner as above, and it was found that the volume mean diameter thereof was 7.8 μm; the static charge, −39.2 μC per gram (see FIG. 4). In addition, the fixing strength and offsetting state of toner F were measured and evaluated in the same manner as in Example 5, and it was found that the transmission density of the black solid-printed surface was 3.11 both before and after rubbing, as shown in FIG. 5. Thus, the difference in transmission density was virtually nonexistent (±0.00), indicating that adequate fixing strength had been achieved. Furthermore, no offsetting was observed.

Example 11

After dyed particles had been obtained in the same manner as in Example 5, fine organic powder N-70 (particle diameter: 0.09 μm; manufactured by Nippon Paint Co., Ltd.) was embedded in an amount of 5 weight parts per 100 weight parts of the dyed particles, and the product, externally added 3 weight parts of the above-described hydrophobic silica, yielding toner G.

Toner G was measured in the same manner as above, and it was found that the volume mean diameter thereof was 7.1 μm; the static charge, −88.2 μC per gram (see FIG. 4). In addition, the fixing strength and offsetting state of toner G were measured and evaluated in the same manner as in Example 5, and it was found that the transmission density of the black solid-printed surface was 2.58 before rubbing and 2.61 after rubbing, as shown in FIG. 5. Thus, the difference in transmission density was virtually nonexistent (−0.03), indicating that adequate fixing strength had been achieved. Furthermore, no offsetting was observed.

Based on the examples described above, it was learned that toners A through G had negative electrification properties and that the static charge on the toners could be increased by coating the dyed particles with fine organic powders.

According to the dry-development toner of the present invention, as described above, fogging, blank spots, and other image defects caused by the presence of charge-controlling agents can be prevented, and the strength with which images are fixed to printing paper can be increased. This is because the surfaces of the dyed resin particles are coated with a fine organic powder having a mean particle diameter of 0.8 μm or less by means of mechanical impact force without the addition of charge-controlling agents, and the static charge on the toner is adjusted using this fine organic powder.

The entire disclosures of the specifications, claims, summaries and drawings of Japanese Patent applications No. 09-225018 filed on Aug. 21, 1997 and No. 09-226022 filed on Aug. 22, 1998 are herein incorporated by reference in their entirety.

What is claimed is:

1. A dry-development toner, comprising resin particles having been colored with a dye, wherein the surfaces of resin particles are coated with a fine organic powder having a mean particle diameter of 0.8 μm or less by means of mechanical impact force.

2. The dry-development toner according to claim 1, wherein the fine organic powder is a fine powder that has been formed from an acrylic resin, fluororesin, or silicon-based resin.

3. The dry-development toner according to claim 1, wherein after coating the surfaces of the resin particles with the fine organic powder, a fine hydrophobic inorganic powder are externally added to the coated resin particles.

4. The dry-development toner according to claim 1, wherein the static charge on the toner is adjusted to between about −2 and about −100 μC per gram of toner.

5. The dry-development toner according to claim 2, wherein the fine organic powder is a fine powder that has been formed from an acrylic resin.

6. The dry-development toner according to claim 2, wherein the fine organic powder is a fine powder that has been formed from a fluororesin.

7. The dry-development toner according to claim 2, wherein the fine organic powder is a fine powder that has been formed from a silicone-based resin.

* * * * *